United States Patent [19]

Lanier

[11] 4,424,901

[45] Jan. 10, 1984

[54] CONVERTIBLE ARTICLE CARRIER

[75] Inventor: Charles E. Lanier, Marietta, Ga.

[73] Assignee: The Mead Corporation, Dayton, Ohio

[21] Appl. No.: 378,841

[22] Filed: May 17, 1982

[51] Int. Cl.[3] ..... B65D 5/36

[52] U.S. Cl. ..... 206/434; 206/141; 229/52 B; 229/52 BC; 229/41 B

[58] Field of Search ..... 206/141, 143, 140, 155, 206/198, 427, 434; 229/40, 52 B, 52 BC, 41 B, 28 BC; 229/30, 31 FS, 41 R

[56] References Cited

U.S. PATENT DOCUMENTS

| | | | |
|---|---|---|---|
| 2,687,247 | 8/1954 | Chidsey, Jr. | 229/41 B |
| 3,747,835 | 7/1973 | Graser | 206/155 |
| 3,750,874 | 8/1973 | Petzel et al. | 206/141 |
| 3,955,745 | 5/1976 | Forrer | 229/52 BC |
| 3,977,518 | 8/1976 | Arneson | 206/141 |
| 4,034,852 | 7/1977 | Forrer | 206/141 |
| 4,062,270 | 12/1977 | Culpepper | 229/40 |
| 4,256,226 | 3/1981 | Stone | 206/427 |
| 4,278,168 | 7/1981 | Wood | 229/28 BC |
| 4,375,258 | 3/1983 | Crayne et al. | 206/141 |

*Primary Examiner*—William T. Dixson, Jr.

*Assistant Examiner*—Bryon Gehman

*Attorney, Agent, or Firm*—Rodgers & Rodgers

[57] ABSTRACT

An article carrier for use as a wrap-around type carrier is adapted for conversion to a basket style carrier and is formed from a generally rectangular blank having top, bottom and side walls which are interconnected to form a tubular structure when wrapped about a group of articles with ends of the blank secured together, a pair of spaced apart generally parallel transverse frangible means formed in the top and side walls to define transverse end panels at each end of the tubular structure and to define a carrying handle therebetween, a web panel foldably joined to each end edge of each of said end panels along a fold line which is normal to the associated end panel and which is foldably joined to the associated side wall along a diagonal fold line so that each web panel is foldable inwardly into contacting relation with the inner surface of the associated side wall following rupture of the frangible means and is foldable simultaneously with swinging movement of the end wall panels into positions astride the ends of the tubular structure to convert the carrier into a basket style carrier.

16 Claims, 5 Drawing Figures

CONVERTIBLE ARTICLE CARRIER

TECHNICAL FIELD

This invention relates to article carriers of the wrap-around type which are formed by machine means about a group of primary packages such as bottles from a generally rectangular blank and includes means for converting the wrap-around carrier to a basket style carrier so as to render the basket style carrier readily usable for returning the primary packages to a supermarket or to some other collection point after the contents have been consumed.

BACKGROUND ART

United Kingdom Pat. No. 944,579 discloses a basket style carrier formed from a blank which is similar to the blank formed according to this invention. This patent is not concerned with providing an article carrier of the wrap-around type and does not disclose frangible means for forming end panels as contemplated by this invention.

United Kingdom Pat. No. 1,101,345 discloses a blank which is similar in some respects to the blank of this invention and the blank of this patent is utilized to form a wrap-around type carrier. The essential feature of this patent concerns the formation of a handle and this patent does not contemplate conversion of a wrap-around carrier into a basket style carrier and there is no frangible means formed according to this invention.

U.S. Pat. No. 2,687,247 discloses a basket style carrier formed from a blank which is somewhat similar to the blank of this invention, but this patent does not teach the conversion of a wrap-around carrier into a basket sytle carrier and does not disclose frangible means.

U.S. Pat. No. 3,747,835 discloses a wrap-around type article carrier in which end retention panels are utilized to aid in securing packaged items within the carrier against dislodgment through the open ends thereof. This patent does not contemplate conversion to a basket style carrier nor does it disclose frangible means which are utilized according to this invention.

U.S. Pat. No. 3,955,745 owned by the assignee of this invention discloses a basket style carrier which is formed during a loading operation from a generally rectangular blank. This patent does not disclose or contemplate a wrap-around type carrier nor does it disclose frangible means according to this invention.

DISCLOSURE OF THE INVENTION

An article carrier according to one form of this invention is formed from a generally rectangular blank and includes top, bottom, and side walls interconnected to form a tubular structure for packaging a group of articles arranged in at least one row when wrapped thereabout and with its ends secured together, a pair of spaced apart generally parallel transverse frangible means formed in the top and side walls to define transverse end panels at each end of the tubular structure and to define a carrying handle therebetween, and a web panel foldably joined to each end edge of each of said end panels along a fold line which is normal to the associated end panel and which is foldably joined to the associated side wall along a diagonal fold line, each of said web panels being foldable inwardly into face contacting engagement with the associated side wall simultaneously with swinging movement of the end wall panels into positions astride the ends of the tubular structure to convert the carrier into a basket style carrier following rupture of the frangible means and unloading of the carrier.

BEST MODE OF CARRYING OUT THE INVENTION

Figure 1:
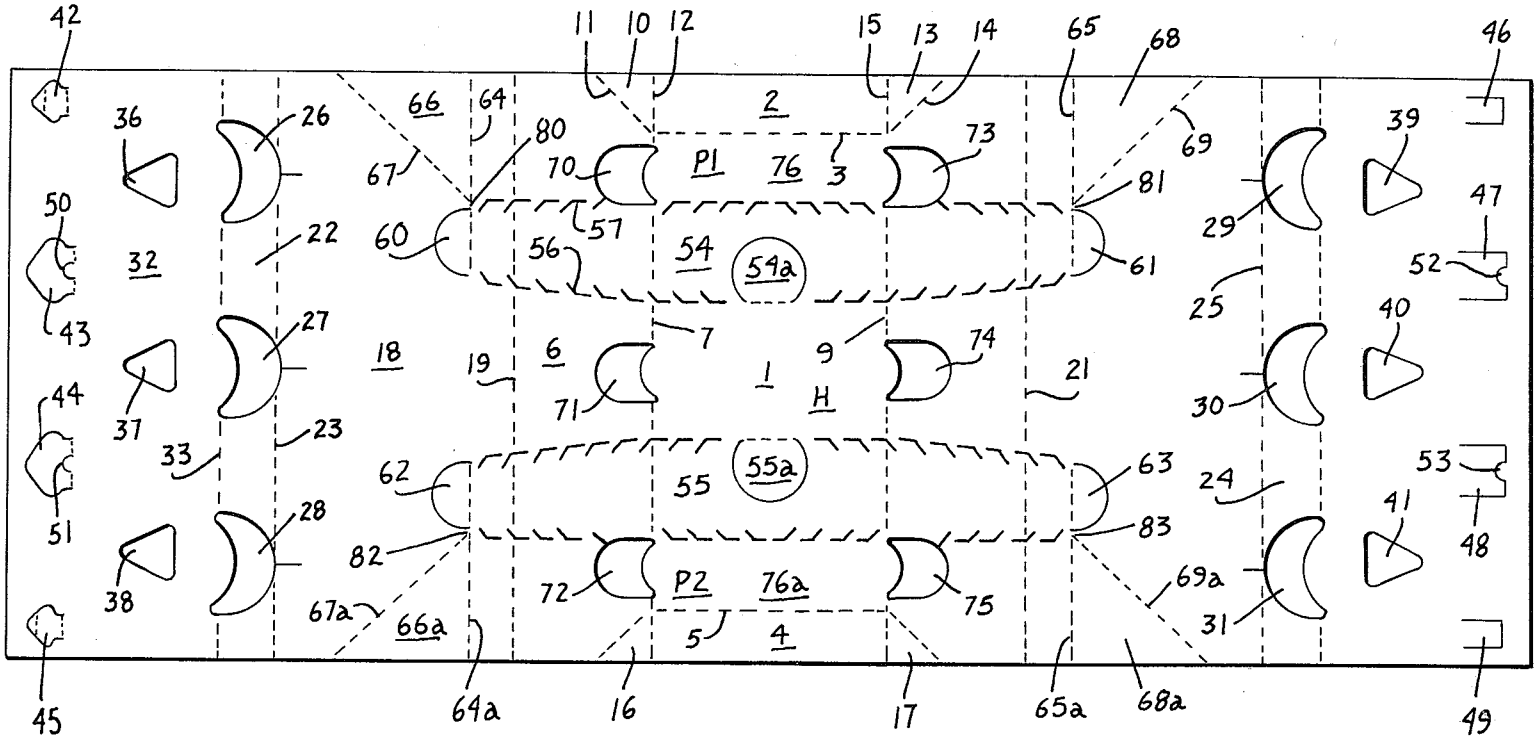
FIG. 1 is a plan view of a blank formed according to this invention.

In the drawings the numeral 1 designates the top wall of the carrier. Bevelled panel 2 is foldably joined to top wall 1 along fold line 3 while bevelled panel 4 is foldably joined to top wall 1 along fold line 5.

Shoulder panel 6 is foldably joined to top wall 1 along fold line 7 while shoulder panel 8 is foldably joined to top wall 1 along fold line 9. Gusset panel 10 is foldably joined to shoulder panel 6 along fold line 11 and to bevelled panel 2 along fold line 12. Similarly gusset panel 13 is foldably joined to shoulder panel 8 along fold line 14 and to bevelled panel 2 along fold line 15. Gusset panels 16 and 17 are related to the other structure in a manner such as gusset panels 10 and 13 and a detailed description thereof is not deemed necessary.

Side wall 18 is foldably joined to shoulder panel 6 along fold line 19 while side wall 20 is foldably joined to shoulder panel 8 along fold line 21. Shoulder panels 6 and 8 are deemed to constitute parts of the side walls 18 and 20 respectively.

Sloping panel 22 is foldably joined to the bottom edge of side wall 18 along a fold line 23 and sloping panel 24 is foldably joined to side wall panel 20 along fold line 25. Bottle retaining apertures 26, 27 and 28 are formed in sloping panel 22 while bottle retaining apertures 29, 30 and 31 are formed in sloping panel 24.

Lap panel 32 is foldably joined to sloping panel 22 along fold line 33 while lap panel 34 is foldably joined to sloping panel 24 along fold line 35.

Wrapper tightening apertures 36, 37 and 38 are formed in lap panel 32 while tightening apertures 39, 40 and 41 are formed in lap panel 34. These tightening apertures function in known manner and simply receive machine tightening elements which effectively tighten the wrapper about a group of articles prior to and during the locking operation.

Locking of the lap panels 32 and 34 together is achieved by locking tabs 42–45 which in known manner are driven through the locking apertures defined by retaining tabs 46–49 respectively. In accordance with U.S. Pat. No. 4,077,095 issued March 7, 1978 and owned by the assignee of this invention, securing apertures 50 and 51 are arranged to receive securing tabs 52 and 53 respectively when the locking tabs 43 and 44 are driven through the apertures defined by retaining tabs 47 and 48 into positions of propped relationship of the retaining tabs to the locking tabs whereby securing tabs 52 and 53 are inserted into the securing apertures 50 and 51 respectively.

According to this invention in one form, transverse frangible means designated by the numerals 54 and 55 are formed in top panel 1 and extend transversely across that panel through the shoulder panels 6 and 8 and into the side walls 18 and 20. Frangible means 54 as shown in FIG. 1 comprises a pair of tear lines 56 and 57 while frangible means 55 comprises a pair of tear lines 58 and 59. A pull tab 60 is formed at one end of tear strip 54 while a pull tab 61 is formed at the other end thereof. These tabs as is apparent from FIG. 1 are struck respectively from side walls 18 and 20. In like fashion pull tab 62 is struck from side wall 18 and is secured to one end of tear strip 55 while pull tab 63 is secured to the other end of tear strip 55 and is struck from side wall 20.

Figure 2:
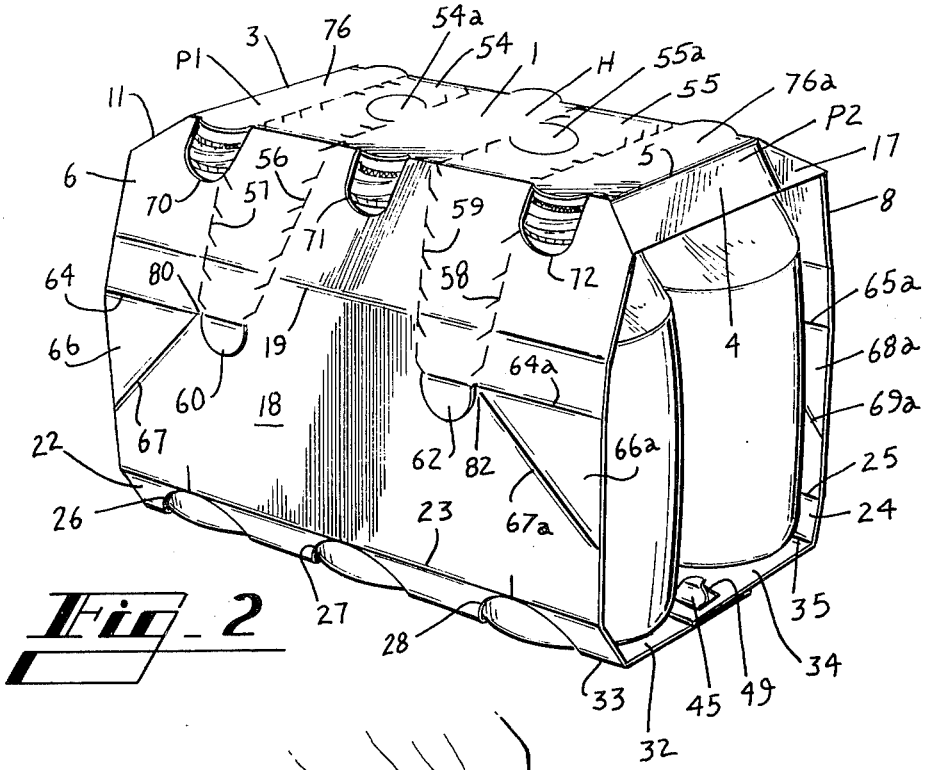
FIG. 2 is a perspective view of a loaded wrap-around type carrier ready for transport from a retail outlet by a consumer.

From the above description it is apparent that with the blank formed as a tubular structure as shown in FIG. 2 for example the tear strip 54 may be removed. By so doing an end panel P1 is defined and extends between tear line 56 and the adjacent edge of the blank as well as from the fold lines 64 and 65 at the ends of this end panel. Thus web panel 66 is foldably joined to the left hand end of the end panel P1 along normal fold line 64 and is adjoined to side wall 18 along a diagonal fold line 67. Similarly web panel 68 is foldably joined to the right hand end of end panel P1 along normal fold line 65 and to side wall 20 along diagonal fold line 69.

Figure 3:
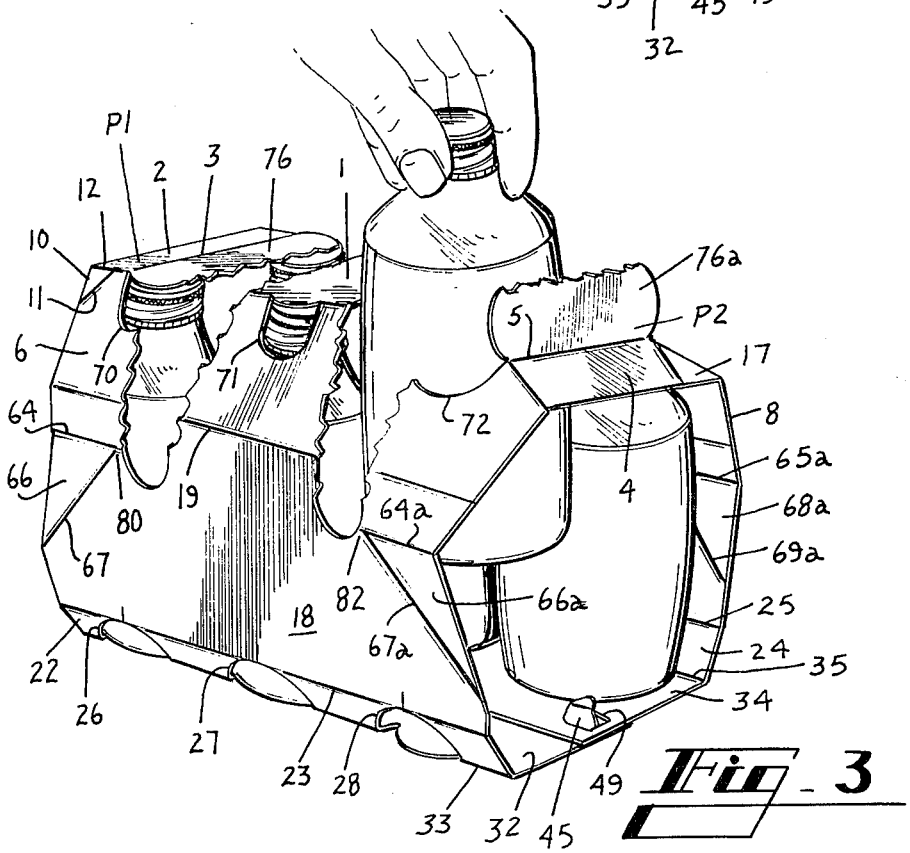
FIG. 3 shows the frangible means formed according to this invention in ruptured condition whereby removal of the packaged bottles is facilitated.

Formed in shoulder panels 6 and 18 and of conventional construction are article retaining apertures 70-75. As is apparent from FIG. 1 the tear line 57 coincides with one edge of article retaining apertures 70 and 73. Thus as is apparent from FIG. 3 removal of a tear strip such as 54 allows the structure bounded by fold line 3, tear strip 57 and by the apertures 70 and 73 and identified by the numeral 76 to fold upwardly thereby facilitating removal of the packaged articles as represented in FIG. 3. Panel **76*a* corresponds to panel 76 and is associated with the tear strip 55. Thus it is obvious that removal of all of the six packaged items is faciliated once the tear strips 54 and 55 are removed and the panels such as 76 and 76*a* are free to fold upwardly as is obvious. The center bottles associated with apertures 71 and 74** may simply be tilted and hence are removable without difficulty once the end bottles are removed.

Since the flap **76*a* and associated parts is similar in structure and function to the flap 76**, a detailed description thereof is not deemed necessary.

For purposes of clarity it is pointed out that end panel P2 is defined as the structure between fold line 58 and the adjacent edge of the blank and fold lines **64*a* and 65*a***.

Figure 4:
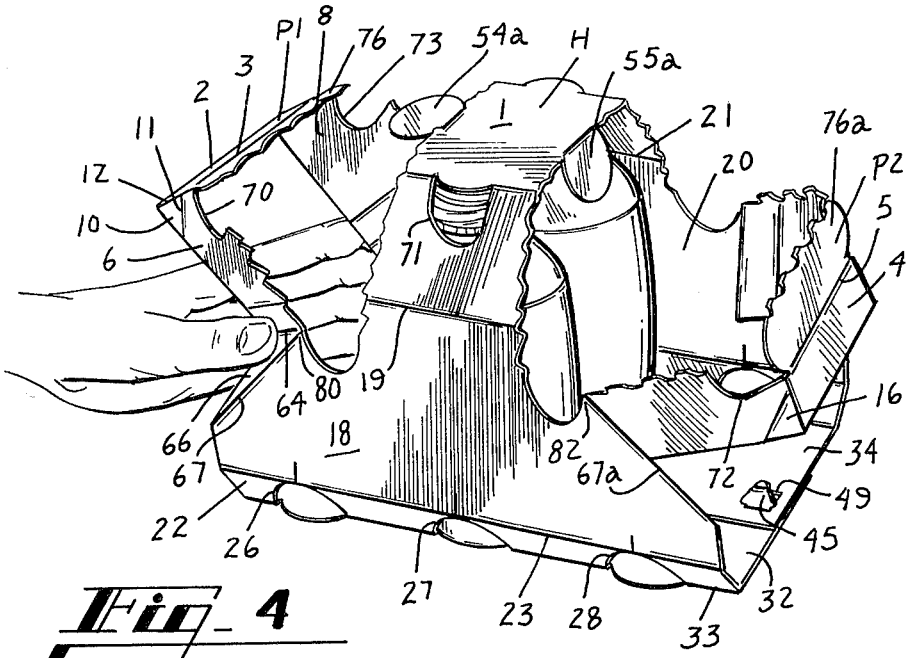
FIG. 4 shows the end panels and associated web panels in the process of being manipulated in such manner as to convert the wrap-around carrier into a carrier of the basket style and FIG. 5 shows the converted carrier of the basket style loaded with articles for convenient return to the point of purchase or to some other disposal point.

Once the articles are removed and the contents thereof consumed, it is desirable to provide for returning the articles as well as the wrapper to the supermarket from which they were purchased or to some other point of disposal. Toward this end, the end panels such as P1 and P2 and the associated web panels such as 66 and 68 and **66*a* and 68*a* are manipulated by simply folding the web panels such as 66 and 68 inwardly along fold lines 67 and 69 into flat face contacting relation with the inner surface of the side walls such as 18 and 20. Web panels 66*a* and 68*a* are similarly folded. These operations are accompanied by swinging movement of the end panels such as P1 and P2 as represented in FIG. 4. These operations convert the carrier into basket style form as shown fully loaded with empty bottles in FIG. 5. Of course the portions of the top wall 1 and of the shoulder panels 6 and 8 as well as of the side walls 18 and 20 which are disposed between the tear lines 56 and 59** then become a handle identified by the letter H.

Figure 5:
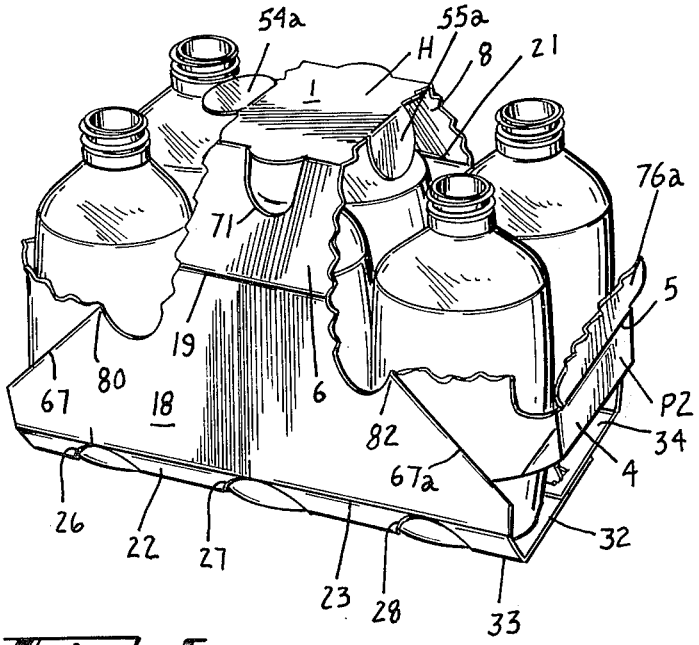

With the carrier conditioned as shown in FIG. 5 with empty bottles for return to the supermarket or to a point of disposal, it is obvious that ecological considerations are well served and that conservation of articles is facilitated. Furthermore litter is eliminated entirely insofar as the packaged product is concerned.

While the drawings show the invention as applied to two rows of three articles each, it will be understood that the invention is not limited to this prticular configuration and that the invention is applicable for packaging different numbers of articles and even can be applied to package a single row of articles.

According to one feature of the invention, it is essential that the tear strip such as 54 extend approximately to the point of intersection of fold lines 64 and 67 which is designated by the numeral 80. Similarly the right hand end of the tear strip 54 must extend to approximately the level of the point 81 which constitutes the point of intersection of fold lines 65 and 69. Similarly the ends of tear strip 55 should be located approximately at the level of points 82 and 83 as is obvious.

As is obvious from FIG. 1 particularly finger gripping tab **54*a* is struck from tear strip 54 while finger gripping tab 55*a* is struck from tear strip 55**. These finger griping tabs and their associated apertures define finger gripping apertures for carrying the carrier in normal usage as a wrap-around device. These tabs do not interfere with the use of the handle structure H as a carrying handle for returning articles the contents of which have been consumed.

Furthermore it is apparent that the web panels 66, 68, **66*a* and 68*a*** preferably are of triangular configuration.

It is also apparent particularly from FIG. 5 that the end panel structure P1 and P2 is disposed approximately midway between the bottoms and the tops of the body portions of the packaged empty bottles. This feature lends a measure of stability to the package.

The bevelled panels 2 and 4 serve as advertising panels and tend to facilitate article retention when disposed in the positions shown in FIG. 2. These bevelled panels do not however interfere with unloading of the carrier as is apparent from FIG. 3 and they serve as a reinforcement for the end panels P1 and P2 as is apparent from FIGS. 4 and 5.

While the transverse frangible means 54 and 55 have been shown as tear strips, it will be understood that the invention is not limited to this particular configuration but is also applicable to an arrangement in which a perforated slit line is substituted for the tear strips such as 54 and 55. In this event, of course, it would not be necessary to provide pull tabs such as 60–63 and would simply be necessary to rupture the uncut portions of the perforated lines which as used herein would constitute frangible means within the meaning of the specification and claims. If perforated tear slits were substituted for the tear strips 54 and 55, it would still be necessary to use the web panels 66, 68, **66*a*, and 68*a***.

INDUSTRIAL APPLICABILITY

This invention is applicable to packaging of consumer items and obviously concerns the return of empty articles such as bottles following consumption of their contents. The invention is of vital significance in jurisdictions where non-returnable type bottles are prohibited for use for example in conjunction with soft drinks and the like and where purchasers are encouraged to return bottles for reuse. Of course reuse of returnable bottles effects substantial conservation of materials such nonreturnable bottles usually are simply discarded and not used again.

I claim:

1. A convertible article carrier which is initially of the wrap-around type and formed from a generally rectangular blank and includes top, bottom and side walls which are interconnected to form a tubular structure for packaging a group of articles arranged in at least one row when the blank is wrapped thereabout and its ends are secured together, the improvement comprising a pair of spaced apart generally parallel transverse frangible means formed in said top wall and extending downwardly into both of said side walls defining transverse end panels at each end of the tubular structure and defining a carrying handle therebetween, and a web panel foldably joined to each end edge of each of said end panels along a fold line which is normal to the associated end panel and foldably joined to the associated side wall along a diagonal fold line, each of said web panels being foldable inwardly following rupture of said frangible means into face contacting engagement with the associated side wall simultaneously with swinging movement of said end wall panels into positions astride the ends of the tubular structure converting the previously formed wrap-around type carrier into a basket style carrier.

2. An article carrier according to claim 1 wherein each of said frangible means comprises a removable tear strip.

3. An article carrier according to claim 2 wherein a pull tab is adjoined to at least one end of each of said tear strips and is struck from the associated side wall.

4. An article carrier according to claim 2 wherein a finger gripping tab is struck from each of said tear strips to define a pair of spaced apart carrying apertures for use when the carrier is in its wrap-around form.

5. An article carrier according to claim 1 wherein each of said web panels is of generally triangular configuration.

6. An article carrier according to claim 1 wherein the intersection of the fold line between each web panel and the associated end panel and the fold line between each web panel and the associated side wall is disposed approximately at the level of the end of the associated frangible means.

7. An article carrier according to claim 1 wherein each of said web panels is folded into flat face contacting relation with the inner surface of the associated side wall.

8. An article carrier according to claim 1 wherein each of said end panels is disposed approximately midway between the bottoms and the tops of the body portions of the packaged articles when the carrier is converted to a basket style carrier.

9. An article carrier according to claim 1 wherein a bevelled panel is foldably joined to each end of said top wall and which forms a downwardly extending projection of each of said end panels.

10. An article carrier according to claim 1 wherein rupture of said frangible means renders the packaged articles readily removable from the tubular carrier without impairing its conversion to a basket style carrier.

11. An article carrier blank of generally rectangular configuration for initial use as a wrap-around carrier adapted for conversion to a basket style carrier comprises a top wall, side walls foldably joined to the side edges of said top wall, a pair of lap panels foldably joined respectively to the bottom edges of said side walls, and a pair of spaced apart generally parallel transverse frangible tear strips formed in said top wall and extending into both of said side walls to define transverse end panels along opposite edges of the blank and to define a carrying handle therebetween.

12. An article carrier blank according to claim 11 wherein a pull tab is adjoined to at least one end of each of said tear strips and is struck from the associated side wall.

13. An article carrier blank according to claim 11 wherein a carrying aperture is struck from each of said tear strips.

14. An article carrier blank according to claim 11 wherein a web panel is foldably joined to each end of each of said end panels and is foldably joined to the associated side wall along a diagonal fold line.

15. An article carrier blank according to claim 11 wherein a bevelled panel forms a part of each of said end panels when the blank is used as a basket style carrier and which is disposed in a downwardly inclined angular relation to said top wall when the blank is used as a wrap-around carrier.

16. An article carrier blank according to claim 11 wherein article retaining apertures are formed in the upper portions of said side walls and wherein said frangible means forms a part of the end ones of said article retaining apertures so that rupture of said frangible means effectively frees that part of the associated end panel which is disposed between said end ones of said article retaining apertures for upward movement thereby facilitating removal of packaged articles from the blank when in wrap-around relation to a group of articles.

* * * * *